US006724293B1

(12) United States Patent
Hofsäss

(10) Patent No.: US 6,724,293 B1
(45) Date of Patent: Apr. 20, 2004

(54) DEVICE HAVING A TEMPERATURE-DEPENDENT SWITCHING MECHANISM PROVIDED IN A CAVITY

(76) Inventor: Marcel Hofsäss, Höfener Strasse 29, 75305 Neuenbürg (DE)

( * ) Notice: Subject to any disclaimer, the term of this patent is extended or adjusted under 35 U.S.C. 154(b) by 0 days.

(21) Appl. No.: 09/557,889

(22) Filed: Apr. 21, 2000

(30) Foreign Application Priority Data

Apr. 30, 1999 (DE) ..... 199 19 648

(51) Int. Cl.[7] ..... H01H 37/54; H01H 37/52
(52) U.S. Cl. ..... 337/365; 337/380; 337/381
(58) Field of Search ..... 337/36, 333, 393, 337/362, 363, 365, 379, 380, 381

(56) References Cited

U.S. PATENT DOCUMENTS

| | | | | |
|---|---|---|---|---|
| 3,378,660 A | | 4/1968 | Dales | |
| 3,430,177 A | | 2/1969 | Audette | |
| 3,443,259 A | * | 5/1969 | Wehl et al. | 337/89 |
| 4,306,211 A | | 12/1981 | Hofsass | |
| 4,470,033 A | * | 9/1984 | Hofsass | 337/343 |
| 4,517,541 A | * | 5/1985 | Ubukata et al. | 337/89 |
| 4,551,702 A | * | 11/1985 | Hire | 337/347 |
| 4,672,353 A | * | 6/1987 | Ubukata et al. | 337/368 |
| 4,849,729 A | * | 7/1989 | Hofsass | 337/102 |
| 5,121,095 A | * | 6/1992 | Ubukata et al. | 337/365 |
| 5,367,279 A | * | 11/1994 | Sakai | 337/104 |
| 5,717,257 A | | 2/1998 | Hofäss | |
| 5,808,539 A | | 9/1998 | White | |
| 5,864,278 A | | 1/1999 | Becher | |
| 5,892,429 A | * | 4/1999 | Hofsass | 337/377 |
| 5,939,970 A | | 8/1999 | Tsuji et al. | |
| 6,054,916 A | | 4/2000 | Hofsass | |
| 6,249,210 B1 | * | 6/2001 | Hofsass | 337/324 |

FOREIGN PATENT DOCUMENTS

| | | |
|---|---|---|
| DE | 22 47 096 B2 | 4/1974 |
| DE | 29 17 482 | 11/1980 |
| DE | 195 06 342 C1 | 5/1996 |
| DE | 196 09 310 A1 | 9/1997 |
| DE | 197 27 383 A1 | 2/1999 |

* cited by examiner

*Primary Examiner*—Anatoly Vortman
(74) *Attorney, Agent, or Firm*—Harness, Dickey & Pierce, P.L.C.

(57) ABSTRACT

A device has an electrical load and a cavity for receiving a temperature-dependent switching mechanism in order to protect the load from overtemperature and/or overcurrent. In the cavity there is a first countercontact for the switching mechanism which is electrically connected to the load, and a second countercontact which is electrically connected to an external terminal for supplying electricity to the load. The cavity is configured for receiving a housingless switching mechanism that, below its response temperature, is in direct contact with the two countercontacts.

12 Claims, 6 Drawing Sheets

DEVICE HAVING A TEMPERATURE-DEPENDENT SWITCHING MECHANISM PROVIDED IN A CAVITY

BACKGROUND OF THE INVENTION

1. Field of the Invention

The present invention relates to a device having an electrical load and a cavity for receiving a temperature-dependent switching mechanism for protecting the load from overtemperature, and/or overcurrent, there being provided in the cavity a first countercontact for the switching mechanism which is electrically connected to the load, and a second countercontact which is electrically connected to an external terminal for supplying electricity to the load.

2. Related Prior Art

A device of this kind is known from DE 195 06 342 C1.

The known device has a cavity into which project two electrodes which grip between them an encapsulated temperature monitor. The first electrode is connected to an external terminal, and the second electrode to an electrical load of the device.

The temperature monitor has a two-part, electrically conductive housing made up of an upper part and lower part that are electrically insulated from one another and receive the gripping forces of the two electrodes. At the same time, the upper part and lower part create the electrical connection to the electrodes.

Arranged in the housing of the temperature monitor is a temperature-dependent switching mechanism that creates, as a function of its temperature, an electrically conductive connection between the upper part and the lower part. As long as the temperature monitor remains below its response temperature, it thus creates an electrically conductive connection between the two electrodes, so that by way of the external terminal, current can flow to the electrical load, which of course is connected to a further external terminal. In the event of an impermissible rise in the ambient temperature and/or an excessive operating current, the temperature-dependent switching mechanism heats up to the point that it interrupts the connection, and the load experiences no current.

A temperature-dependent switching mechanism such as the one used in the temperature monitor utilized in the known device is known, for example, from DE 29 17 482 C2. The temperature-dependent switching mechanism comprises a spring disk that centeredly carries a movable contact on which a bimetallic snap disk is centeredly arranged. The temperature-dependent switching mechanism constitutes a lossproof unit.

Below the response temperature, the spring disk is braced at the bottom on its rim against the lower part of the temperature monitor, and pushes the movable contact element against the interior of the upper part so that a current can flow from the upper part, via the contact element and the spring disk, into the lower part. In this switch position, the bimetallic snap disk exerts no force. If the temperature then rises, the bimetallic snap disk snaps over from its convex shape into a concave shape, thereby bracing itself against the interior of the upper part and pushing the movable contact element away from the upper part against the force of the spring disk, so that the switch constituted by the temperature monitor is opened. Also to be mentioned in this context is an insulating layer, on the interior of the upper part, which prevents the bimetallic snap disk from coming into electrical contact with the upper part.

The temperature monitor known from DE 29 17 482 C2 is highly pressure-resistant, so that it can be used with the device as described in DE 195 06 342 C1. A pressure-resistant housing of this kind is necessary so that the gripping forces for retaining the temperature monitor can be designed to be sufficiently great such that mechanical and electrical contact can reliably be made to the temperature monitor even in the presence of severe vibrations, for example when used in a drain pump of a washing machine.

An advantage of the known device is that the temperature monitor used is not one that is usually equipped with soldered or crimped terminals, but rather the also known temperature monitor having the two-part metal housing, so that very easy installation and contacting of the temperature monitor in the known device can be achieved. Because of its insensitivity to pressure, the known temperature monitor can be stocked as a bulk item, and during final assembly of the known device simply needs to be inserted—optionally by way of an automatic production machine—between the two resilient electrodes, where it is simultaneously held in place mechanically and electrically contacted.

Although the known device is very satisfactory in terms of assembly engineering, and although secure retention of the temperature monitor is also achieved, it nevertheless has the disadvantage that a more expensive temperature monitor needs to be used because of the need for a pressure-resistant housing.

SUMMARY OF THE INVENTION

In view of the above, it is an object of the present invention to improve the device mentioned at the outset in such a way that it can be equipped in economical fashion with a temperature-dependent switching function that moreover can easily be installed and contacted.

According to the present invention, this object is achieved, in the case of the device mentioned at the outset, in that the cavity is configured for receiving a housingless switching mechanism that, below its response temperature, is in direct contact with the two countercontacts.

The object underlying the invention is completely achieved in this fashion.

Specifically, the inventor of the present application has recognized that it is possible to insert, so to speak, "naked" switching mechanisms directly into a cavity provided on a device, this switching mechanism then being clamped between the two countercontacts. As a result, on the one hand it is no longer necessary for the countercontacts to be of resilient configuration, and on the other hand it is additionally possible to dispense with a housing for the temperature-dependent switching mechanism. It is thus possible to use economical switching mechanisms, and lesser demands are also made on the countercontacts in the cavity, which can now be rigid electrodes or contact points. What is exploited in this context is the fact that each temperature-dependent switching mechanism is in any case already designed so that it is clamped in its housing between the two countercontacts in such a way that it remains securely positioned and contacted even when used in a severely vibration-affected environment. The spring forces of the bimetallic element and/or of the spring element of the temperature-dependent switching mechanism necessary for this purpose are relatively small, since the mass of the "naked" switching mechanism is already kept as low as possible simply in order to achieve short switching times.

This means, however, that the forces necessary for secure retention of a switching mechanism are much lower than the forces needed, in the case of the device mentioned at the outset, to securely retain the temperature monitor, with its metal housing that is very heavy by comparison with the switching mechanism.

The use of a housingless switching mechanism thus yields cost advantages not only in terms of the device, in which resilient countercontacts are no longer necessary, but also because the housing of the temperature monitor can be dispensed with.

Of course the new device offers all the advantages that were already present in the context of final assembly of the known device: no soldering or crimping operations are necessary in order to make contact to the switching mechanism, and the switching mechanism merely needs to be placed into the cavity. It is true that housingless switching mechanisms cannot readily be stocked as bulk goods, since any mechanical stress, in particular bending of the bimetallic elements, must be avoided so that their functional reliability is not negatively affected.

The inventor of the present application has recognized, however, that it is easily possible for switching mechanisms such as those known from the aforementioned DE 29 17 482 C2, i.e. those which constitute a lossproof unit, to be stocked like tablets in blister packs. The switching mechanisms are placed into depressions, arranged in rows and columns, that are arranged in a plastic film or the like. "Grouped" packages of this kind are extremely economical, so that by way of this additional feature, considerable price advantages as compared to the known temperature monitors can nevertheless be attained because of the elimination of the housing. A further advantage with this manner of stocking the housingless switching mechanisms is that the switching mechanisms are delivered already sorted, so that the device manufacturer can easily insert them into the cavity using an automatic production machine.

It is preferred in general if a cover is provided that sealingly closes off the cavity after the switching mechanism has been set in place, the cover being attached to the device preferably in articulated fashion, more preferably by way of a film hinge.

The advantage of this feature is that the switching mechanism can be efficiently protected from dirt, water, etc. With encapsulated temperature monitors, on the other hand, sealing against dirt and moisture is a major problem, since because of the small outside dimensions of the temperature monitors, it is generally difficult to provide an extremely good seal. With the new device, on the other hand, the cover makes it possible to close off the cavity in absolutely secure fashion, for example using a labyrinth seal. If the cover is, in this context, attached to the device in articulated fashion, preferably by way of a film hinge, this simplifies both the production of the device and the final assembly of the switching mechanism.

It is further preferred if one of the two countercontacts, preferably the second countercontact, is arranged on the cover.

This feature is advantageous, for example, in the case of a cavity which is open at the top, into which the switching mechanism is first placed in such a way that it comes to rest on the first countercontact, whereupon closing the cover not only effects sealing but simultaneously also makes contact with the second countercontact. This prevents the switching mechanism from getting caught on one of the two countercontacts upon placement into the cavity and being mechanically damaged.

It is further preferred if a switching mechanism that is a lossproof unit, made up of a bimetallic element and a movable contact element that coacts with one of the two counter-contacts, is placed into the cavity, the switching mechanism preferably comprising a spring element, held in lossproof fashion on the contact element, that coacts with the other of the two countercontacts.

The advantage with this feature is that the switching mechanism can be placed into the cavity as a unit, so that only a single handling step is necessary in order to equip a prefabricated device with a temperature-dependent switching mechanism and with the protective function associated therewith.

It is preferred in general if the switching mechanism is attached to a guide element that is inserted together with the switching mechanism into the cavity, the guide element preferably acting as a cover and closing off the cavity in sealed fashion.

The advantage here is that the switching mechanism can be installed easily, since handling robots can grasp the guide element much more easily than they can the switching element itself. This therefore makes possible rapid and economical installation of the switching mechanism in the new device, with no risk of damage to the switching mechanism.

It is preferred in this context if one of the two countercontacts, preferably the second countercontact, is arranged on the guide element.

The guide element either can be part of the housing or can be supplied together with the switching mechanism. Especially if the guide element is part of the housing—i.e. is joined, for example like a cover, to the housing by way of a film hinge—the second countercontact and the associated external terminal can easily be provided on the guide element or, as already mentioned above, on the cover. As already was the case with the cover equipped with the second countercontact, the guide element equipped in this fashion also has the advantage that when the switching mechanism is inserted into the cavity there is no danger that the switching mechanism will jam between the two countercontacts in such a way that it is mechanically damaged. This feature as well, therefore, helps make possible automatic installation of the switching mechanism in the device.

It is preferred in this context if the bimetallic element is configured as a bimetallic tongue that at its first end is attached to the guide element and at its free end carries the movable contact element.

The advantage here is that a very simple switching mechanism is used, which not only is very economical but also can easily be inserted into the cavity.

On the other hand, it is preferred if the spring element is configured as a spring tongue that at its first end is attached to the guide element and at its second end is joined to a first end of the bimetallic element, which at its free end carries the movable contact element.

This switching mechanism also is very robust and easy to install; in addition, the series connection of the temperature-neutral spring tongue and the bimetallic element means that contact is made very reliably between the movable contact element and the countercontact.

A further advantage with the two switching mechanisms just described is that they can easily make contact with the second countercontact at the bimetallic tongue or spring tongue attached to the guide element. For example, it is possible to bring the countercontact and the spring tongue or bimetallic tongue into contact with one another and then injection-mold a plastic part around them, so that all the parts are held non-displaceably and securely in physical contact with one another.

On the other hand, it is preferred if the spring element has a retaining extension piece that is attached to the guide element.

The advantage here is that it is possible to use a temperature-dependent switching mechanism such as the one known from DE 197 05 154 A1. This switching mechanism combines the advantages of the switching mechanism known from DE 29 17 482 C2—according to which the contact pressure is created solely by the spring element which also carries the switching current—and of the guide element already mentioned above which makes possible automatic and reliable installation.

If the switching mechanisms are attached to a guide element and that guide element is supplied by the switching mechanism manufacturer, the switching mechanism can advantageously be inserted during transport into a protective sheath which is closed off by the guide element.

In view of the above, the invention also concerns a protective sheath for a temperature-dependent switching mechanism attached to a guide element; the guide element and the switching mechanism can be configured in the manner already set forth above in connection with the device.

In the simplest case, the protective sheath can be a plastic cap that is slid onto the guide element and thus, during transport, protects the switching mechanism held by it from mechanical damage and from dirt and moisture. When the switching mechanism is installed in the device to be protected, a handling robot then grasps the guide element, whereupon the protective sleeve is stripped off, for example by a further device, before the handling robot introduces the switching mechanism, with the guide element, into the cavity. If the guide element is equipped with a labyrinth seal, the guide element automatically centers itself on the opening of the cavity, thereby avoiding any mechanical damage to the switching mechanism.

Further advantages are evident from the description and from the appended drawings.

It is understood that the features recited above and those yet to be explained below can be used not only in the respective combinations indicated, but also in other combinations or in isolation, without leaving the context of the present invention.

BRIEF DESCRIPTION OF THE DRAWINGS

Embodiments of the invention are shown in the drawings and will be explained in more detail in the description below.

In the drawings.

DESCRIPTION OF PREFERRED EMBODIMENTS

Figure 1:
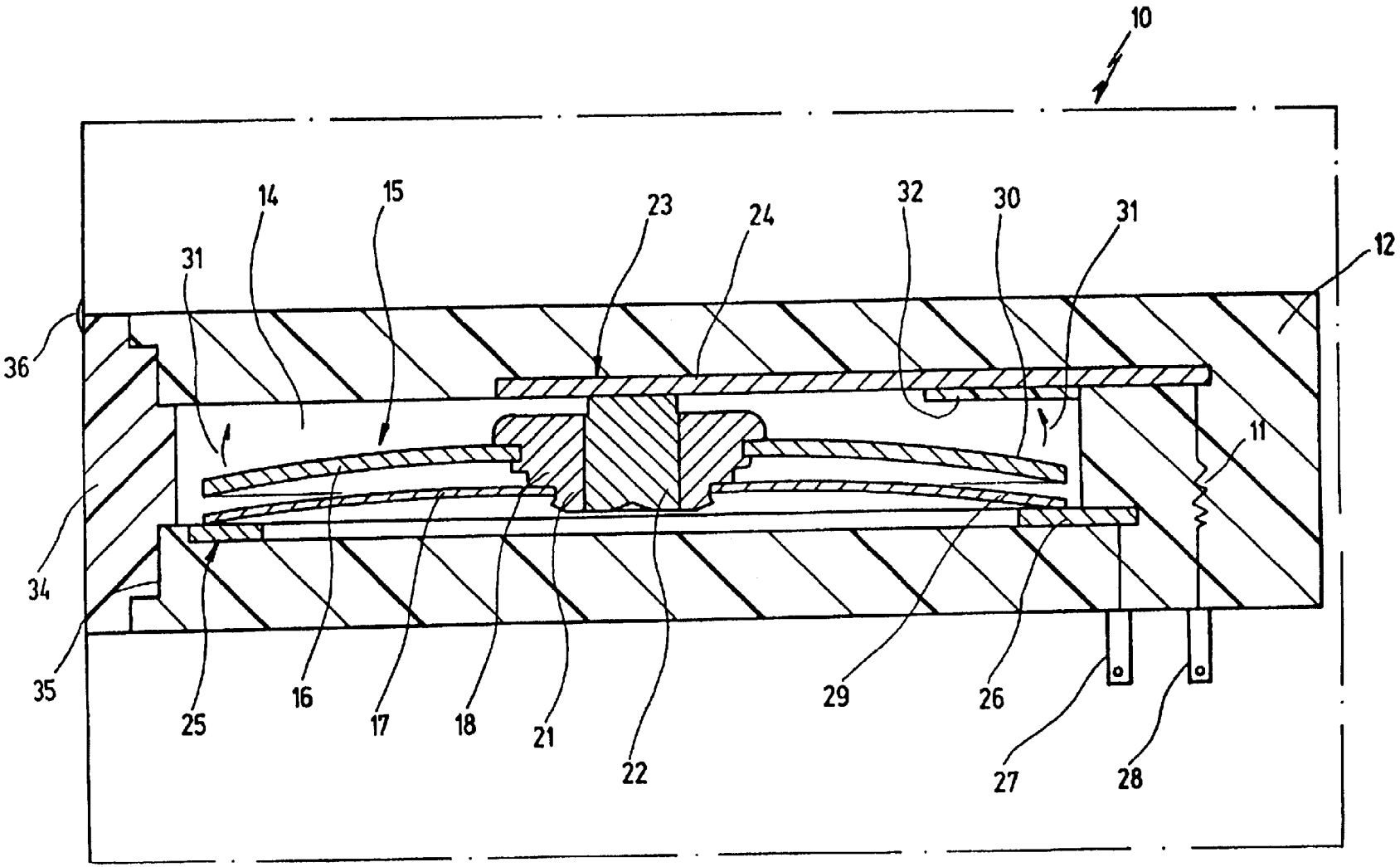
FIG. 1 shows, in a longitudinally sectioned side view, a first embodiment of the new device in which a switching mechanism is placed loosely into the cavity.

In FIG. 1, 10 designates in general a device which comprises an electrical load 11 that is arranged in a housing part 12, schematically indicated, made of plastic.

Device 10 can be, for example, a drain pump for a washing machine; electrical load 11 then symbolizes the motor that is arranged in its housing.

A cavity 14 in which a temperature-dependent switching mechanism 15 is arranged is provided in housing part 12. Switching mechanism 15 comprises, in a manner known per se, a bimetallic disk 16 and a spring disk 17, both of which are retained in lossproof fashion on a movable contact element 18. Contact element 18 has a jacket 21 made of softer metal and a core 22 made of harder metal having good electrical conductivity. After bimetallic disk 16 and spring disk 17 have been placed onto jacket 21, it can then be deformed so that switching mechanism 15 forms a lossproof unit.

Provided in cavity 14, at the top in FIG. 1, is an electrode 23 that coacts as first countercontact 24 with the movable contact element 22. Arranged on the other side of cavity 14 is an annular electrode 25 that coacts as second countercontact 26 with switching mechanism 15. Second countercontact 26 is connected—as indicated by a line—to an external terminal 27 of device 10. A second external terminal 28 is connected to load 11, which is connected at the other end to first countercontact 24.

In the switch position shown in FIG. 1, switching mechanism 15 is below its switching temperature, and spring disk 17 is braced with its rim 29 against second countercontact 26 and thereby presses movable contact element 22 against first countercontact 24. An electrically conductive connection is thereby created from external terminal 27 via second countercontact 26, spring disk 17, movable contact element 22, and first countercontact 24 to load 11, which in turn is connected to the other external terminal 28.

When the temperature of load 11, which is located in the immediate vicinity of cavity 14, then rises impermissibly, bimetallic disk 16 therefore snaps over from the convex shape shown in FIG. 1 into a concave shape, and its rim 30 moves upward in the direction of arrows 31. Rim 30 ultimately comes into contact with the upper side of cavity 14, and thereby pushes the movable contact element downward in FIG. 1 so that the electrical connection between first countercontact 24 and second countercontact 26 is interrupted. In order to prevent a short circuit between rim 30 of bimetallic disk 16 and first countercontact 24, an insulating layer 32 of housing part 12, which comes into contact with rim 30 at the right in FIG. 1, is provided.

Cavity 14 is closed off, at the left in FIG. 1, by a cover 34; a kind of labyrinth seal 35, with which penetration of dirt or moisture into cavity 14 is effectively prevented, is configured between housing part 12 and cover 34. Cover 34 is joined to device 10 by way of a film hinge 36.

Figure 2:
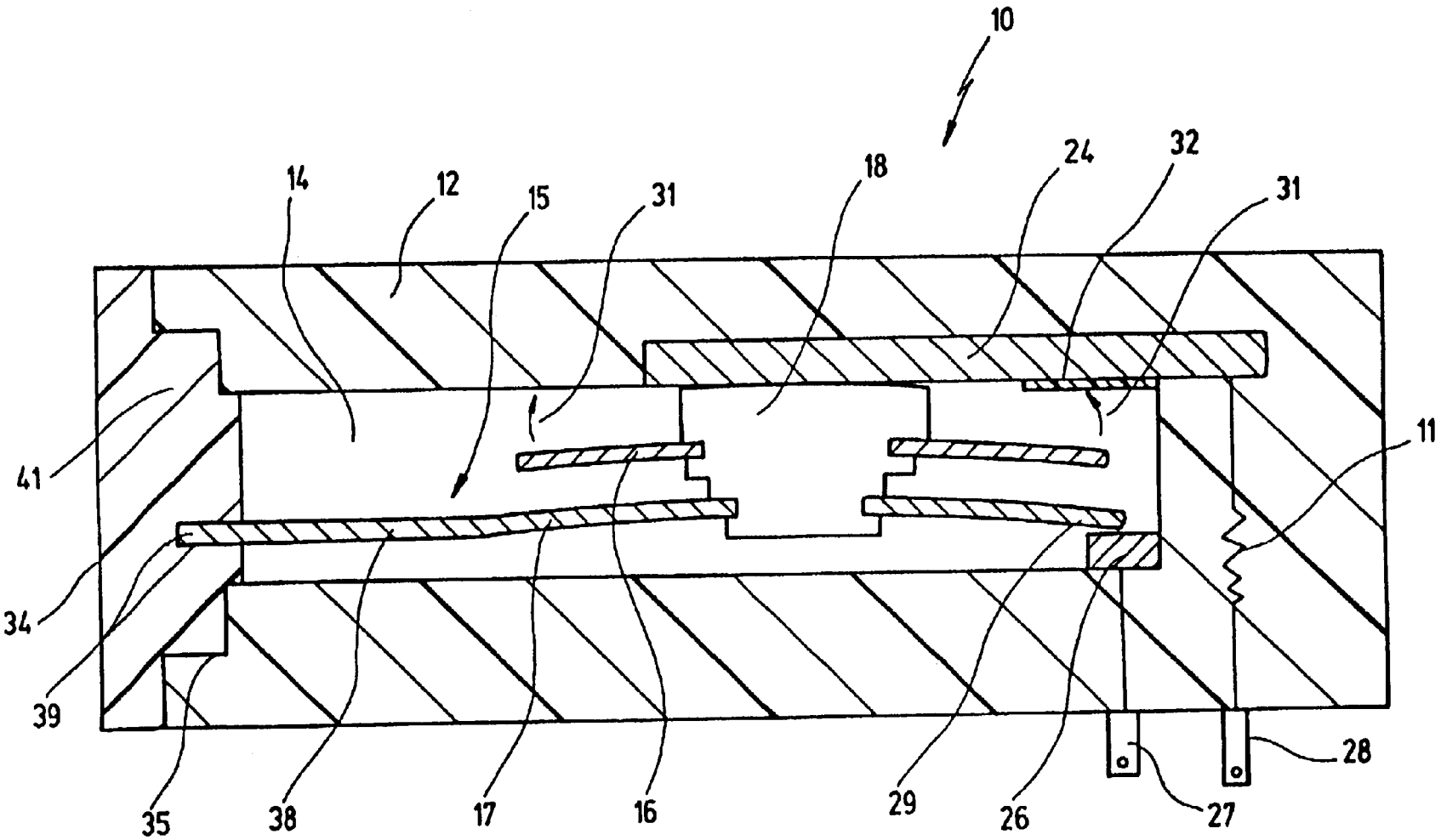
FIG. 2 shows, in a representation like that of FIG. 1, a device in which a switching mechanism is held on the guide element.

Device 10 shown in FIG. 2 is similar in configuration to the device in FIG. 1, but spring disk 17 is joined to a retaining extension piece 38 that is attached at its free end 39 to a guide element 41 that is part of cover 34.

This kind of design of a temperature-dependent switching mechanism 15 is known from DE 197 05 154 A1, and reference is therefore made to that document for further information.

Spring disk 17 is now braced with its rim 29 against second countercontact 26 which lies opposite guide element 41, and in the low-temperature position shown in FIG. 2 once again pushes movable contact element 18 against first countercontact 24. As for the rest, identical reference characters here refer to the same features of device 10 as in FIG. 1.

Figure 3:
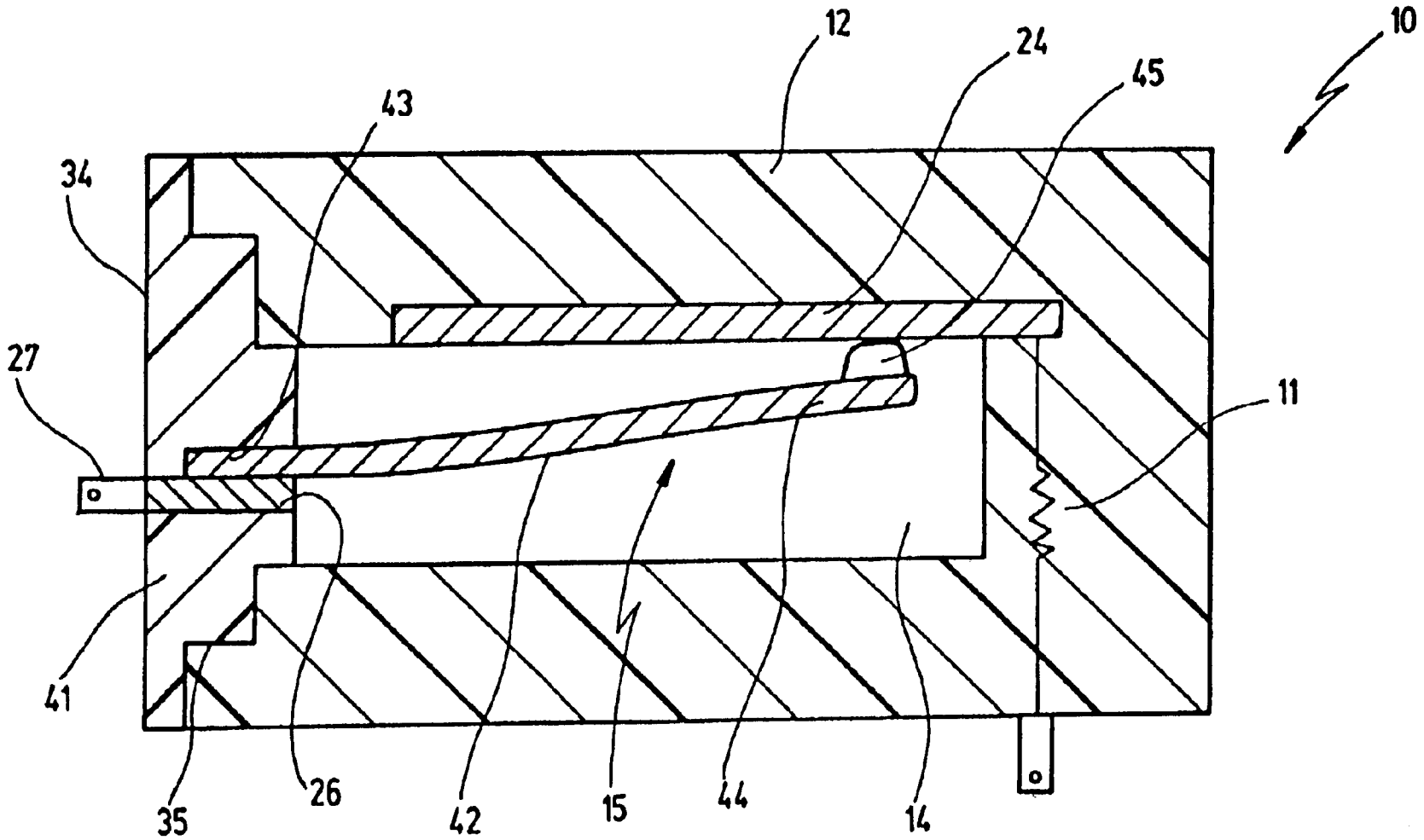
FIG. 3 shows a representation like that of FIG. 2, but with a different embodiment for the temperature-dependent switching mechanism.

In the device shown in FIG. 3, switching mechanism 15 comprises a bimetallic tongue 42 that is attached at its first end 43 to guide element 41 and is in electrical contact there with second countercontact 26 that is provided there. Here as well, external terminal 27 is provided on guide element 41.

Bimetallic tongue 42 carries at its free end 44 a movable contact element 45 that coacts with first countercontact 24.

Figure 4:
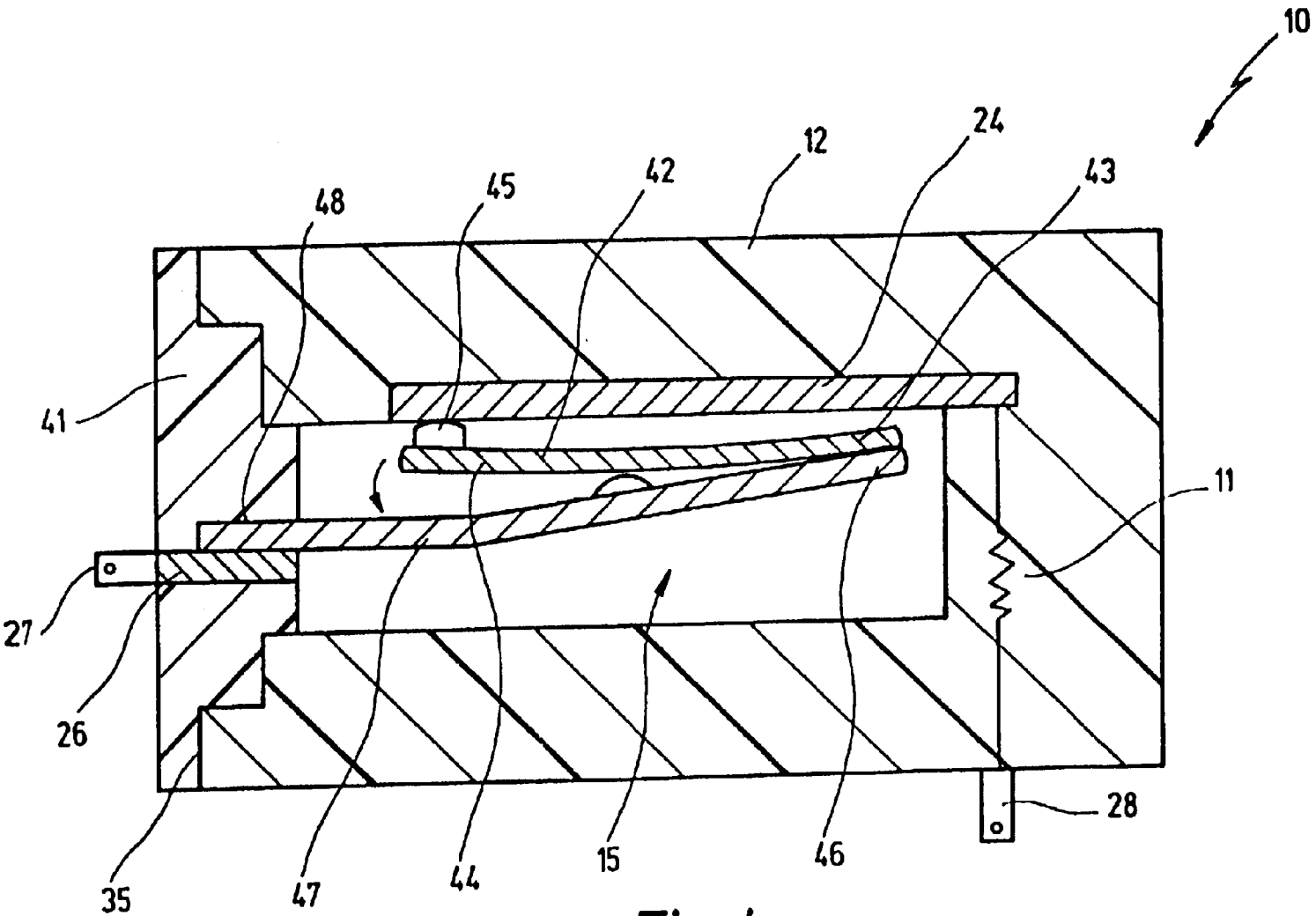
FIG. 4 shows a further representation like that of FIG. 2, with a further embodiment for the temperature-dependent switching mechanism.

FIG. 4 shows, in a manner comparable to the embodiment according to FIG. 3, a device 10 in which bimetallic tongue 42 is attached not directly to guide element 41 but rather to a free end of a spring tongue 47 that in turn is attached at its other end 48 to guide element 41 and is in contact there with second countercontact 26.

In devices 10 described so far, a housingless switching mechanism 15 is placed into cavity 14 and is clamped between the two countercontacts 24 and 26 as a result of the inherent spring force of spring disk 17, bimetallic tongue 42, and/or spring tongue 47. Switching mechanisms 15 are introduced laterally into cavity 14, which is then closed off by cover 34 on which can be provided a guide element 41 that carries the switching elements as shown in FIGS. 2, 3, and 4. Labyrinth seal 35 provides guidance during introduction of the switching mechanisms into cavity 14, so that mechanical damage to switching mechanisms 15 is prevented.

Figure 5:
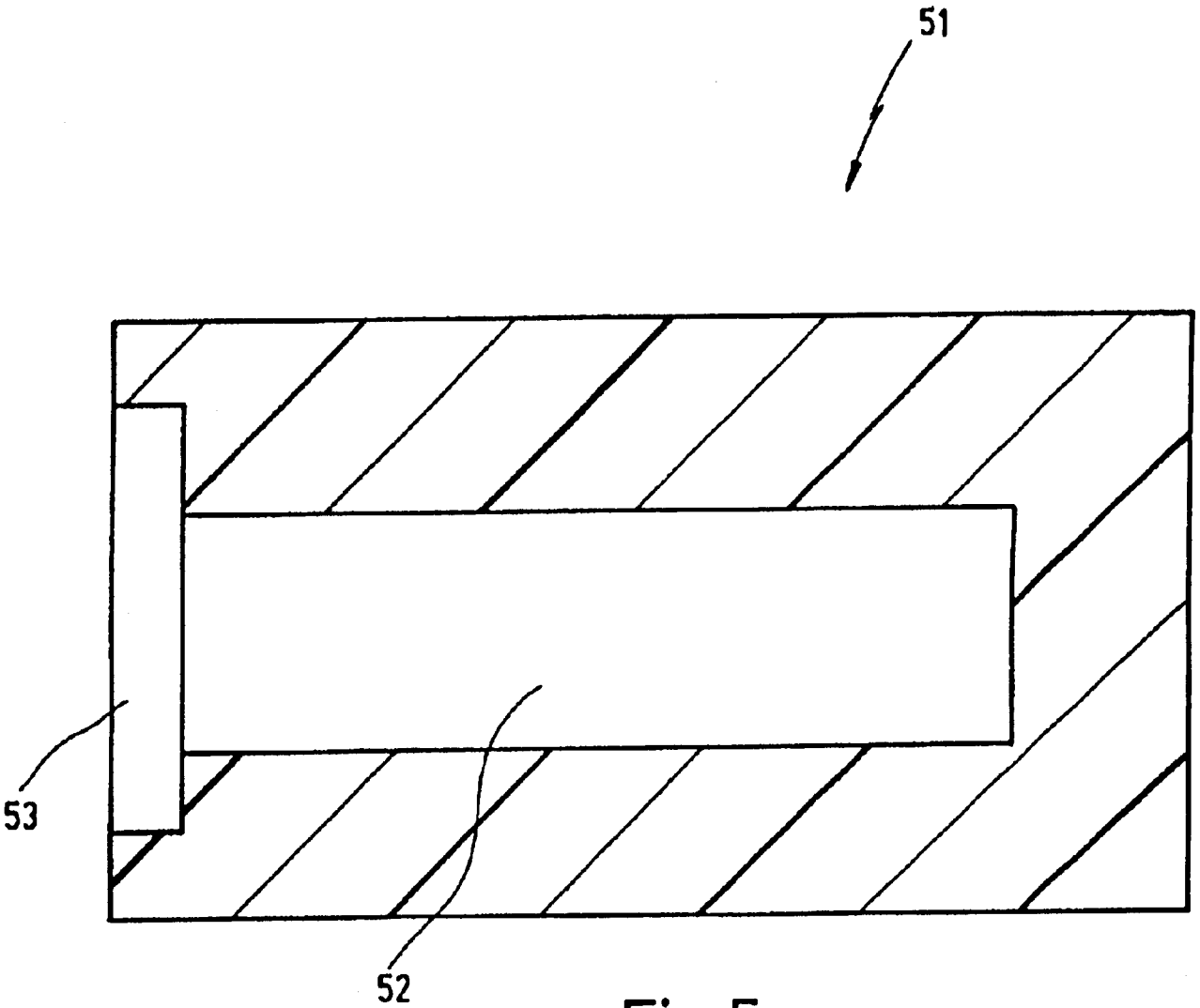
FIG. 5 shows a protective sheath for the switching mechanisms of FIGS. 2 through 4.

During transport, switching mechanisms 15 as shown in FIGS. 2 through 4 can be stored in a protective sheath 51 shown in FIG. 5, which has an interior space 52 to receive switching mechanism 15 as well as an opening 53 into which guide element 41 can be inserted. In the simplest case, protective sheath 51 is a plastic cap that sits on guide element 41 and protects switching mechanism 15 from mechanical damage and from dirt and moisture.

Figure 6:
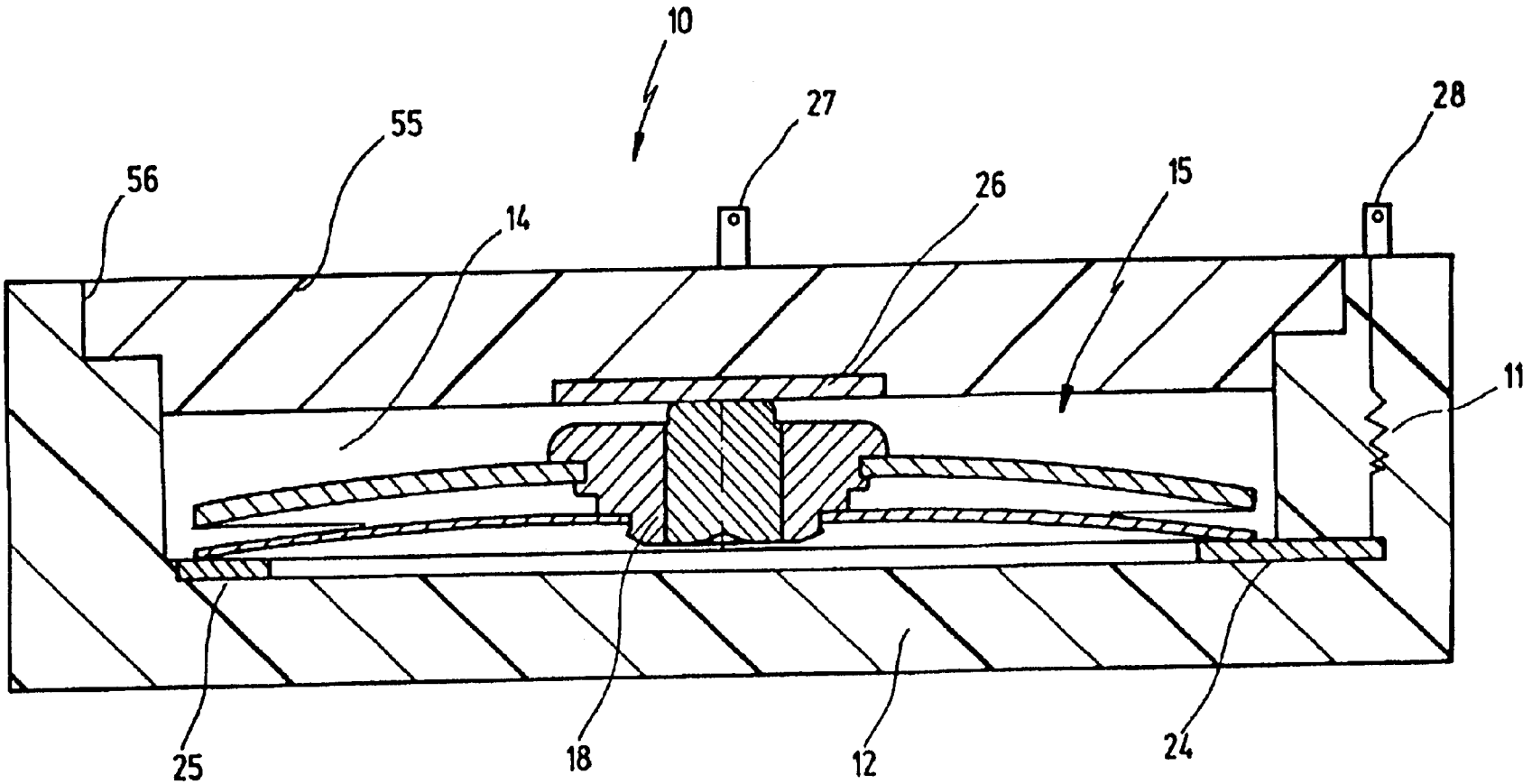
FIG. 6 shows a further embodiment of the new device with a switching mechanism like the one in FIG. 1.

FIG. 6 shows yet another embodiment of cavity 14 which, in this case, is open at the top. Switching mechanism 15 of FIG. 1 is placed into cavity 14; a cover 55 sits in an opening 56, open at the top, of housing part 12.

Second countercontact 26, which is connected via a connection to external terminal 27, is now arranged on this cover 55. In this case, annular electrode 25 forms first countercontact 24, which is connected via load 11 to external terminal 28.

In the case of device 10 as shown in FIG. 6, switching mechanism 15 can be placed into cavity 14 from above with no danger of jamming between the two counterelectrodes 24, 26, since counterelectrode 26 is not brought into contact with switching mechanism 15 until after switching mechanism 15 has been placed into cavity 14. The same advantages are also achieved with devices 10 according to FIGS. 3 and 4, in which the switching mechanism is already immovably joined to second counterelectrode 26 before it is introduced into cavity 14.

Therefore, what I claim, is:

1. A device, comprising an electrical load, a housing part, an external terminal for supplying electricity to said load, a housingless temperature-dependent switching mechanism protecting said load from overtemperature and overcurrent, respectively, a cavity which is provided in said housing part and in which said switching mechanism is placed, a first and a second countercontact being provided in said cavity, said first countercontact being electrically connected to said load and said second countercontact being electrically connected to said external terminal, said cavity being configured to receive said housingless switching mechanism such that said switching mechanism when being below its response temperature is in direct electrical contact with said first and second countercontacts for electrically interconnecting said first and second countercontact with each other, wherein said switching mechanism is configured as a lossproof unit comprising a bimetallic element and a movable contact element that coacts with one of said two countercontacts, and wherein said switching mechanism comprises a spring element that is held in lossproof fashion on said contact element that coacts with the other of said two countercontacts, said spring element being configured as a spring tongue that at its first end is attached to a guide element and at its second end is joined to a first end of said bimetallic element, which at its free end carried said movable contact element.

2. A device as in claim 1, wherein a cover is provided that sealingly closes off said cavity after said switching mechanism has been set in place.

3. A device as in claim 2, wherein said cover is attached to said device in articulated fashion.

4. A device as in claim 1, wherein the bimetallic element is configured as a bimetallic tongue that at its first end is attached to said guide element and at its free end carries said movable contact element.

5. A device as in claim 1, wherein said spring element has a retaining extension piece that is attached to said guide element.

6. A device, comprising an electrical load, a housing part, an external terminal for supplying electricity to said load, a housingless temperature-dependent switching mechanism protecting said load from overtemperature and overcurrent, respectively, a cavity which is provided in said housing part and in which said switching mechanism is placed, a cover that sealingly closes off the cavity after said switching mechanism has been set in place, a first and a second countercontact wherein one of the two countercontacts is arranged on the cover and the other countercontact is provided in said cavity, said first countercontact being electrically connected to said load and said second countercontact being electrically connected to said external terminal, said cavity being configured to receive said housingless switching mechanism such that said switching mechanism when being below its response temperature is in direct electrical contact with said first and second countercontacts for electrically interconnecting said first and second countercontact with each other, wherein said switching mechanism is configured as a lossproof unit comprising a bimetallic element and a movable contact element that coacts with one of said two countercontacts, and wherein said switching mechanism comprises a spring element that is held in lossproof fashion on said contact element that coacts with the other of said two countercontacts, said spring element being configured as a spring tongue that at its first end is attached to a guide element and at its second end is joined to a first end of said bimetallic element, which at its free end carries said movable contact element.

7. A device as in claim 6, wherein said cover is attached to said device in articulated fashion.

8. A device as in claim 6, wherein said second countercontact is arranged on said cover.

9. An electrical device comprising an electrical load, a housing, an external terminal for supplying electricity to said load, a cavity provided in said housing, a first countercontact that is electrically connected to said load, a second countercontact that is electrically connected to said external terminal, said first and said second countercontact being provided in said cavity, and a housingless temperature-dependent switching mechanism for protecting said load at least from overtemperature or overcurrent, wherein said switching mechanism is configured as a lossproof unit and comprises a bimetallic element and a movable contact element and is inserted into said cavity such that said movable contact element is, when its temperature is below its response temperature, in direct electrical contact with one of said countercontacts so that said switching mechanism electrically interconnects said first and said second countercontact; and wherein said switching mechanism comprises a spring element that is held in lossproof fashion on a contact element that coacts with the other of said two countercontacts; and further wherein said spring element is configured as a spring tongue that at its first end is attached to a guide element that is inserted together with said switching mechanism into said cavity, and at its second end is joined to a first end of said bimetallic element, which at its free end carries said movable contact element.

10. An electrical device comprising an electrical load, a housing, an external terminal for supplying electricity to said load, a cavity provided in said housing, a first countercontact that is electrically connected to said load, a second countercontact that is electrically connected to said external terminal, said first and said second countercontact being provided in said cavity, and a housingless temperature-dependent switching mechanism for protecting said load at least from overtemperature or overcurrent, wherein said switching mechanism is configured as a lossproof unit and comprises a bimetallic element and a movable contact element and is inserted into said cavity such that said movable contact element is, when its temperature is below its response temperature, in direct electrical contact with one of said countercontacts so that said switching mechanism electrically interconnects said first and said second countercontact; and wherein said switching mechanism comprises a spring element that is held in lossproof fashion on a contact element that coacts with the other of said two countercontacts; and further wherein said spring element has a retaining extension piece that is attached to a guide element that is inserted together with said switching mechanism into the cavity.

11. An electrical device comprising an electrical load, a housing, an external terminal for supplying electricity to said load, a cavity provided in said housing, a cover that sealingly closes off the cavity, a first countercontact that is electrically connected to said load, a second countercontact that is electrically connected to said external terminal, wherein one of said countercontacts is arranged on said cover and the other of said countercontacts is provided in said cavity, and a housingless temperature-dependent switching mechanism for protecting said load at least from overtemperature or overcurrent, wherein said switching mechanism is configured as a lossproof unit and comprises a bimetallic element and a movable contact element and is inserted into said cavity such that said movable contact element is, when its temperature is below its response temperature, in direct electrical contact with one of said countercontact so that the switching mechanism electrically interconnects said first and said second countercontact; and wherein said switching mechanism comprises a spring element that is held in lossproof fashion on a contact element that coacts with the other of the two countercontacts and further wherein said spring element is configured as a spring tongue that at its first end is attached to a guide element that is inserted together with said switching mechanism into said cavity, and at its second end is joined to a first end of said bimetallic element, which at its free end carried movable contact element.

12. An electrical device comprising an electrical load, a housing, an external terminal for supplying electricity to said load, a cavity provided in said housing, a cover that sealingly closes off the cavity, a first countercontact that is electrically connected to said load, a second countercontact that is electrically connected to said external terminal, wherein one of said countercontacts is arranged on said cover and the other of said countercontacts is provided in said cavity, and a housingless temperature-dependent switching mechanism for protecting said load at least from overtemperature or overcurrent, wherein said switching mechanism is configured as a lossproof unit and comprises a bimetallic element and a movable contact element and is inserted into said cavity such that said movable contact element is, when its temperature is below its response temperature, in direct electrical contact with one of said countercontact so that the switching mechanism electrically interconnects said first and said second countercontact; and wherein said switching mechanism comprises a spring element that is held in lossproof fashion on a contact element that coacts with the other of the two countercontacts; and further wherein said spring element has a retaining extension piece that is attached to a guide element that is inserted together with said switching mechanism into said cavity.

* * * * *